US006276097B1

(12) United States Patent
Whitley

(10) Patent No.: US 6,276,097 B1
(45) Date of Patent: Aug. 21, 2001

(54) METHOD AND APPARATUS FOR STABILIZING STRUCTURES

(76) Inventor: Joel Edwin Whitley, 12611 St. Martin Rd., Oakboro, NC (US) 28129

( * ) Notice: Subject to any disclaimer, the term of this patent is extended or adjusted under 35 U.S.C. 154(b) by 0 days.

(21) Appl. No.: 09/532,813

(22) Filed: Mar. 21, 2000

Related U.S. Application Data

(63) Continuation of application No. 09/126,562, filed on Jul. 30, 1998.

(51) Int. Cl.[7] ..... E04G 21/04
(52) U.S. Cl. ..... 52/127.2; 52/758; 249/20
(58) Field of Search ..... 52/127.2, 745.17, 52/747.12, 749.13, DIG. 11, 218, 568, 223.5

(56) References Cited

U.S. PATENT DOCUMENTS

| | | | |
|---|---|---|---|
| 1,670,338 | 5/1928 | Butterworth . | |
| 1,675,749 | 7/1928 | Crawford . | |
| 2,091,875 | 8/1937 | Oesterling . | |
| 2,114,901 | 4/1938 | Henderson . | |
| 2,308,943 | 1/1943 | Tietig et al. . | |
| 3,841,596 | 10/1974 | Cull . | |
| 3,882,654 | 5/1975 | Yancey . | |
| 4,174,911 | 11/1979 | Maccario et al. . | |
| 4,974,700 | 12/1990 | Gates . | |
| 5,444,952 | 8/1995 | Jackson . | |
| 5,970,668 * | 10/1999 | Arthurs et al. | 52/219 |

* cited by examiner

*Primary Examiner*—Carl D. Friedman
*Assistant Examiner*—Steve Varner
(74) *Attorney, Agent, or Firm*—Summa and Allan, P.A.

(57) ABSTRACT

A method and apparatus for reinforcing and stabilizing a structure formed of stacked blocks, such as a pier used in a building's foundation. The method and apparatus employ brackets to bracket the edges of the structure and transiting members to transit the body of the structure. Stabilizing members engage with the transiting members. The stabilizing members are then tightened against the brackets thereby compressing, reinforcing and stabilizing the structure.

30 Claims, 2 Drawing Sheets

METHOD AND APPARATUS FOR STABILIZING STRUCTURES

This application is a continuation of co-pending U.S. application Ser. No. 09/126,562 filed Jul. 30, 1998.

FIELD OF THE INVENTION

The present invention relates to construction of residential and commercial buildings. In particular, the present invention relates to stabilizing block piers utilized as supports for residential and commercial buildings.

BACKGROUND

Proper construction of residential and commercial buildings requires that the building be as level as possible. In many instances, the ground on which the building is constructed is not level. Monetary concerns, engineering factors or other circumstances may make it impractical to engage earth moving equipment to level out the lot on which the building is to stand. In such circumstances, the building is usually built upon a network of piers and beams which provide a level foundation for the remainder of the structure. The use of height adjusting piers is especially prevalent in the "set-up" of mobile and modular residential and commercial buildings.

Height adjusting piers are often constructed of tiers of concrete masonry blocks laid in a "basketweave" pattern. The first tier of blocks is laid with the next tier perpendicular or 90° offset from the first tier. The tiers continue this alternating pattern until the desired height is reached. Typically, the upper tiers are not secured by mortar as the pier is built because final adjustments to the height of the pier may be necessary.

The use of piers as support structures creates the potential for future problems and this potential must be addressed during construction. Simply stated, a column with constant cross-sectional area loses stability against torsional loading as it gets higher. For example, as the height of a pier increases, it loses its ability to withstand toppling under a direct wind applied against the side of the building it supports. Over time wind, settling of the structure and ground and other factors can loosen the blocks in the pier thereby creating the potential for catastrophic failure of the building's foundation.

Accordingly, almost all states and counties have building codes that govern the use of piers in residential and commercial buildings, and particularly with regard to the set-up of mobile homes and modular buildings. For example, the State of North Carolina requires a professional engineer to certify the set-up of a mobile or modular building if over twenty-five percent (25%) of the piers are in excess of thirty-six (36) inches in height. Typically, the set-up of these "over-high" mobile home and modular buildings requires some type of reinforcement of the piers. The most common method of reinforcing piers for mobile homes and modular buildings is to plaster the piers with a material known in the trade as "surwall". Surwall is a dry, powdered concrete product that has fiberglass reinforcement mixed in with the powder. Surwall is mixed with water and applied over the outer surfaces of the pier. Once the surwall dries, the blocks in the pier are secured into position from the plastering effect of the surwall.

Using surwall as a means for reinforcing piers is undesirable for several reasons. For example, using surwall can be a time consuming undertaking. Two hours is often required to reinforce a single pier that is seventy-two (72) inches high. In addition, the mixing, spreading and clean-up of surwall poses the same difficulties as concrete. Both men and material are tied up cleaning equipment after the surwall is applied. Surwall also prevents reuse of the blocks. If the building is to be moved, as mobile and modular buildings often are, the pier must be removed. The surwall ensures that the blocks in the pier must be broken apart which usually damages the blocks.

Another known method for stabilizing a structure formed of multiple stacked blocks is discussed in U.S. Pat. No. 5,444,952 to Jackson ("Jackson"). Jackson discusses stabilizing a brick chimney by placing angle iron at each of the four corners of a chimney, wrapping cables around the chimney and angle iron then tightening the cables.

The Jackson apparatus and method are inadequate in that they rely upon cables which are susceptible to stretching or cutting. Further, although the Jackson apparatus provides external compression to help stabilize the chimney, the Jackson apparatus lacks interior cross members to help stabilize the structure against torsional loadings. Thus, a chimney incorporating the Jackson apparatus remains susceptible to failure under torsional loadings.

Accordingly, a need exists for an apparatus and method for quickly and efficiently securing and stabilizing buildings incorporating piers formed of stacked blocks. This apparatus and method should be compatible with traditional methods of block pier construction and should allow the re-use of blocks if the mobile home or modular building is relocated.

OBJECT AND SUMMARY OF THE INVENTION

Therefore, it is an object of the present invention to provide a method and apparatus to reinforce and stabilize a structure, such as a pier, formed of stacked blocks. A further object of the invention is to provide a method and apparatus for stabilizing a pier against torsional loadings such as those caused by wind. A still further object of the invention is to provide a method and apparatus for reinforcing and stabilizing a pier that is simple to construct and deconstruct and permits reuse of the blocks that form the pier.

The above objects are met by a method of reinforcing a structure against torsional loadings where that structure is formed of at least two tiers of stacked blocks having at least two opposing faces. The method comprises bracketing the edges of at least two opposing faces of the stacked blocks with brackets of sufficient length to extend across the junction of at least two tiers. The method further comprises transiting the stacked blocks with a transiting member that intersects the two opposing faces intermediate of the brackets, placing stabilizing members across the bracketed opposing tiers such that the stabilizing members are transverse to the brackets, and establishing tension between the stabilizing members along the transiting member.

Stated alternatively, the method comprises torsionally reinforcing a structure formed of at least two tiers of stacked polygonal blocks having at least first and second opposing faces. The reinforcement is accomplished by establishing first, second and third force focal points on the first face wherein the focal points are linearly arranged with the first and third focal points proximate the edges of the first face and the second focal point intermediate the first and third points. Fourth, fifth and sixth force focal points are also established on the second face. The fourth, fifth and sixth focal points are linearly arranged with the fourth and sixth focal points proximate the edges of the second face. The fifth focal point is intermediate the fourth and sixth focal points. Further, the fourth, fifth and sixth focal points are opposed, respectively, to the first, second and third focal points. A compressive force is then applied along the line established between the second and fifth focal points thereby creating compressive force acting on the first and second faces. The compressive forces formed at the second and fifth focal points are distributed transversely along the first and second faces to create compressive forces at the first, third, fourth and sixth focal points.

The objects of the invention are further met by an apparatus for reinforcing and stabilizing a structure formed of at least two tiers of stacked blocks having at least two opposing faces. In particular the apparatus reinforces and stabilizes a structure, such as a pier, against torsional loadings. The apparatus comprises at least four brackets positioned along the edges of at least two opposing faces of the stacked blocks. Preferably, the brackets are of sufficient length to extend across the junction of at least two tiers. The apparatus further comprises at least two stabilizing members. At least one stabilizing member is situated across each of the bracketed opposing faces of the stacked blocks such that said stabilizing members traverse said brackets. A tensioning member that transits the structure is positioned intermediate the brackets. The tensioning member engages with and couples the stabilizing members thereby establishing contact between the stabilizing members and the brackets.

DETAILED DESCRIPTION OF THE PREFERRED EMBODIMENTS

Figure 1:
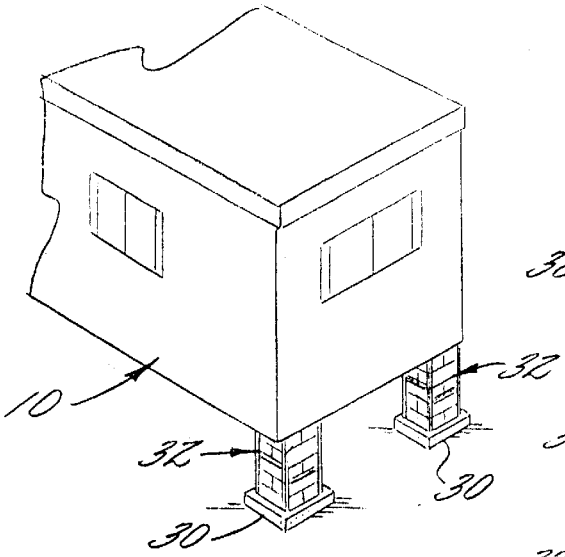
FIG. 1 is an environmental view of one embodiment of the invention.

The present invention is a method and apparatus for stabilizing structures such as mobile and modular buildings. In its broadest sense, the invention is a method and apparatus for stabilizing a structure formed of stacked blocks. In preferred embodiments, the invention is an apparatus and method for stabilizing a pier formed of standard sized construction blocks such as masonry blocks or bricks as shown in FIG. 1. The invention, however, is adaptable for use with any construction material, such as polygonal blocks, that allows for the formation of a structure having generally continuous edges and faces.

The following description is based upon utilization of the invention to reinforce and stabilize a pier supporting a mobile home. The description of the invention in this environment should not be viewed as limiting the scope of the invention. Those skilled in the art will readily recognize the utility of the invention in other applications such as securing a brick wall or platform.

Figure 2:
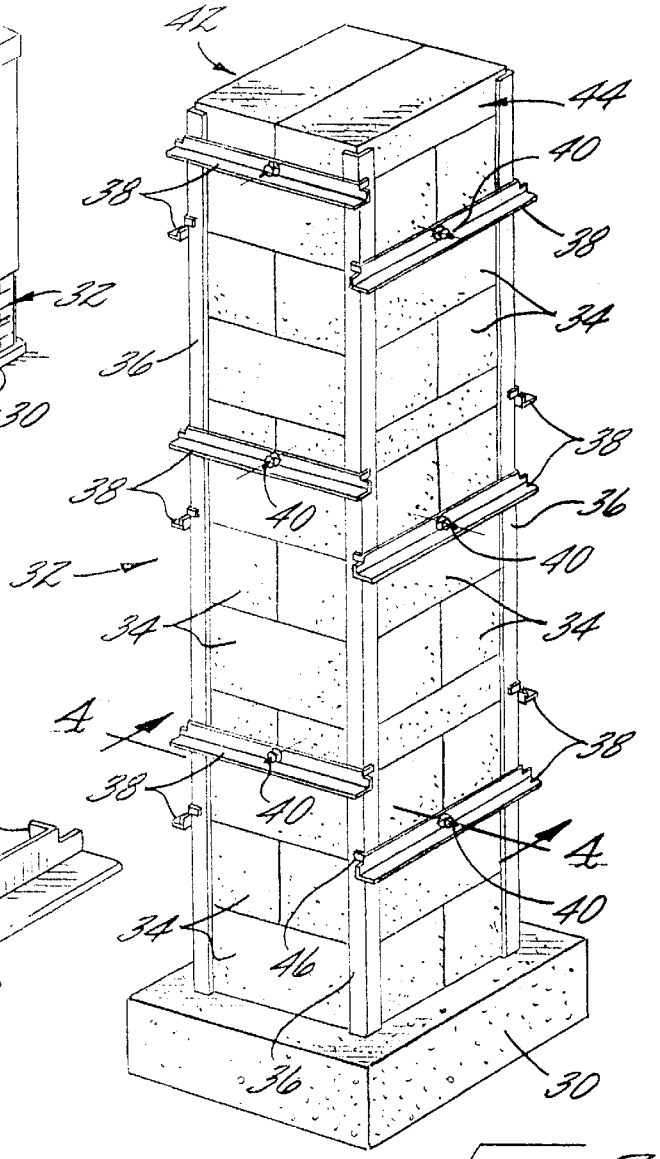
FIG. 2 is a perspective view of the apparatus according to the invention.
Figure 5:
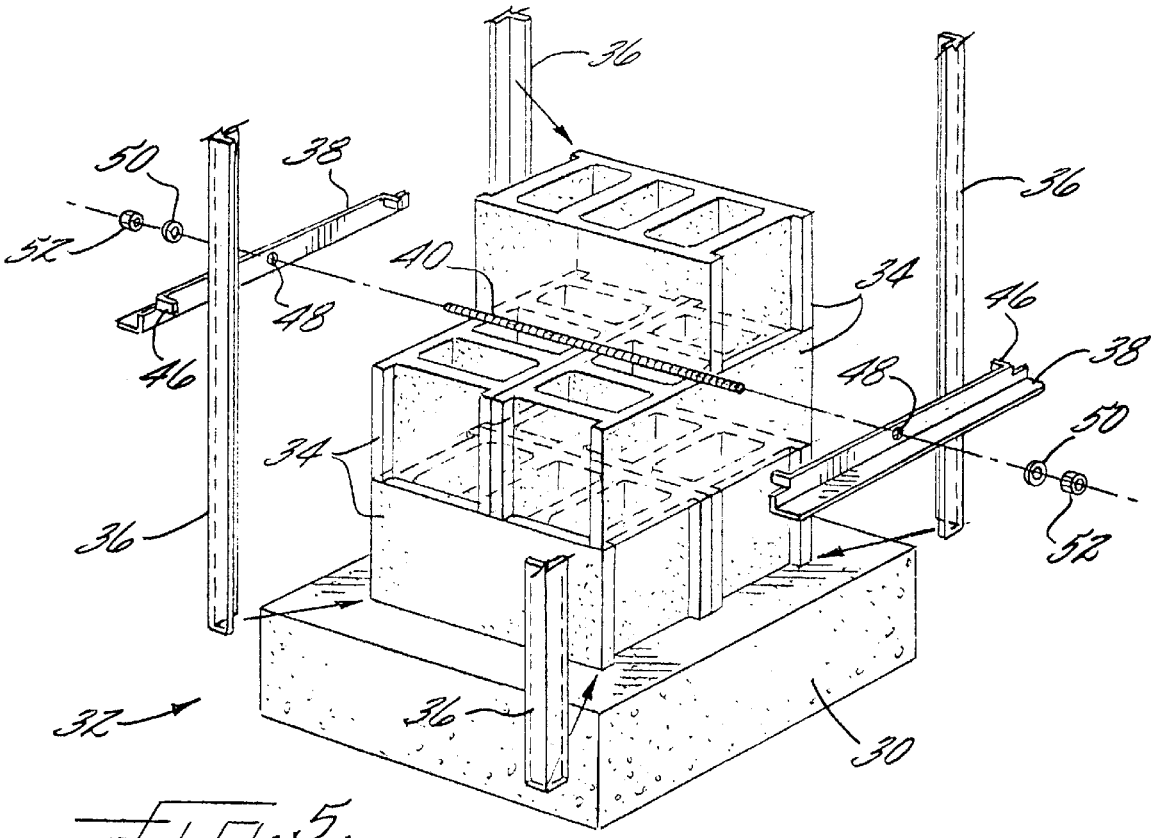
FIG. 5 is an exploded perspective view of one embodiment of the invention.

FIG. 2 shows a typical support structure for a mobile home comprising a reinforced footing 30 and pier broadly designated at 32 formed of concrete blocks 34. In this particular arrangement, the pier 32 is constructed on the footing 30 using blocks set in an alternating or "basketweave" pattern as shown in FIG. 5. Alternating tiers may be formed of blocks differing in size from the previous tier. In FIGS. 2 and 5, the bottom or first tier is formed of two 8"×8"×16" concrete blocks laid side by side to form a square 16"×16". The subsequent tiers are formed of 8"×8"×16" or 4"×8"16" concrete blocks laid perpendicular or 90° offset from the preceding tier. The size and shape of the blocks do not limit the utilization of the invention. The blocks forming the pier may be drystacked, mortared or solid grouted depending upon the utilization of the pier and local building codes.

Traditional methods of stabilizing the piers employ a concrete-like substance that is plastered over the outside of the pier. As discussed previously, this method is fraught with problems. By employing the invention during or after construction of the pier, the pier may be properly stabilized while avoiding the problems associated with traditional stabilizing methods.

Referring now to FIG. 5, the apparatus according to the invention comprises at least four brackets, one of which is illustrated at 36, two stabilizing members, one of which is illustrated at 38, and one transiting member, 40. In a preferred embodiment the apparatus according to the invention is incorporated into the construction of the pier 32 in the following manner. A first tier of blocks having opposing faces and top and bottom surfaces is placed upon a footing 30 with the bottom surface of the first tier being adjacent to the footing 30. Succeeding tiers having substantially the same cross-sectional area as the first tier are then built upon the first tier. The succeeding tiers possess top and bottom surfaces with the bottom surface of one tier resting upon the top surface of the immediately preceding tier to form a multi-tiered pier having two perpendicular sets of parallel opposing faces.

Figure 4:
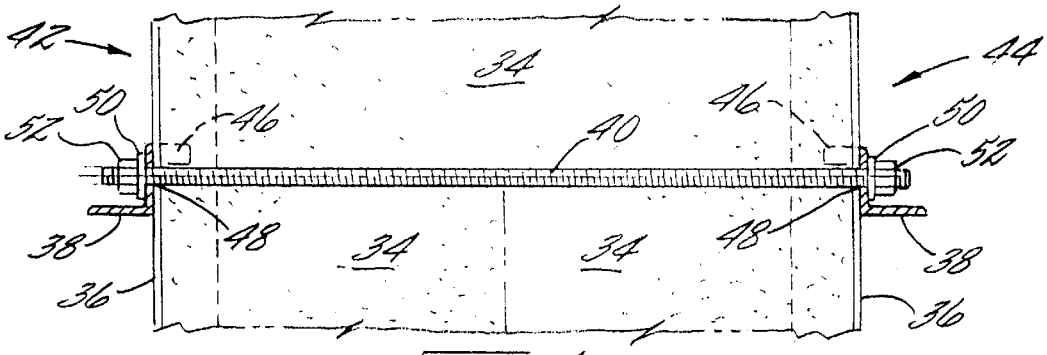
FIG. 4 is a cross-sectional view taken along line 4—4 of FIG. 2.

After the pier is built to the desired height, a masonry bit is used to drill a pathway through the pier for placement of the transiting member 40. Alternatively, as the tiers are laid, the transiting members 40 are placed across the top of a tier prior to laying a succeeding tier. Preferably the transiting members 40 are situated at the junction of the two blocks forming the upper tier of a tier pair as shown in FIGS. 2 and 5. The transiting member is thereby placed in the approximate horizontal center of the pier 32 where it extends outwardly and horizontally through the pier and perpendicularly intersects opposing faces of the pier 32 as shown in FIG. 4. In the embodiments shown in FIGS. 4 and 5, the transiting member 40 is preferably a ⅜" diameter all-thread rod of high grade steel such as A588. The transiting member 40 is of sufficient length to completely transit the pier 32 and intersect the opposing faces 42 and 44, of the pier 32. The transiting members 40 utilized in the embodiment shown in FIG. 2 are approximately 18" in length thereby providing a 1" projection on either side of the 16" pier 32. Depending upon the type of block used in constructing the pier 32, the blocks used at the location of the transiting member may need to be slightly beveled along a face or edge to accommodate the diameter of the transiting member 40.

The transiting members 40 may be placed between every tier or they may be separated by a number of tiers. Recommended spacings for transiting members are between 16" and 32" with a transiting member positioned within 24" inches of the footer 30 and within 24" of the top of the pier 32.

After the pier 32 and the desired number of transiting members 40 are in place, the brackets 36 are placed at the corners of at least two opposing faces of the stacked blocks that form the pier. In a preferred embodiment the brackets 36 are made of high grade 1½"×1½"×⅛" angle steel The brackets 36 are cut to be of a length (or height) sufficient to extend at least above the first tier of a two tier group. Stated alternatively, the brackets 36 are long enough to encompass a junction of at least two tiers of blocks. In a more preferred embodiment the brackets 36 extend for the height of the pier 32 as shown in FIG. 2.

The brackets 36 are positioned such that the interior angle of the bracket wraps around the corner of two opposing faces (e.g. 42, 44) of the pier 32. In the embodiment shown in FIGS. 2 and 5, the brackets 36 enclose the corners of all four opposing faces of the pier 32.

Figure 3:
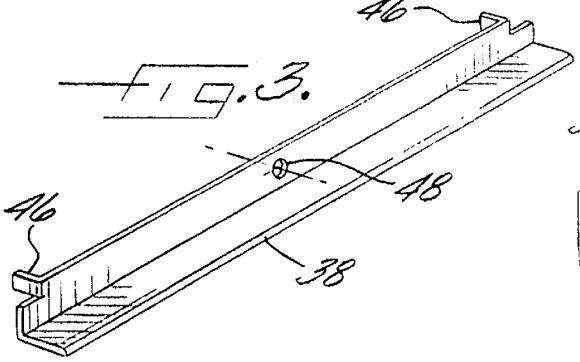
FIG. 3 is a perspective view of a stabilizing member according to the invention.

The stabilizing members 38 are distributed along the length of the pier in conjunction with the transiting members 40. The stabilizing members 38 are elongated bar-like structures with a length at least as great as the width of the face of the pier against which they are placed. In preferred embodiments the stabilizing members 38 are of a length greater than the width of the face of the pier to be stabilized. In the embodiment shown in FIG. 3, the stabilizing members 38 are formed of A36 grade 1½×1½×1⅛" angle steel cut in 18" lengths thereby providing an approximately 1" overlap on either side of the pier 32.

The stabilizing members 38 may also comprise at least two tabs 46 (FIG. 3) with one tab located near each end of the stabilizing member 38. Alternatively, the stabilizing members 38 may have flush or non-tabbed ends. The stabilizing members 38 further comprise a hole 48 situated intermediate the ends of the stabilizing member 38. In the embodiment shown in FIGS. 3 and 5, the hole 48 is centrally located along the portion of the angle steel having the tabs 46.

At least one stabilizing member 38 is placed across each of the two opposing faces of the pier such that each of the stabilizing members 38 transverse two of the brackets 36 as shown in FIG. 2. In preferred embodiments, one stabilizing member 38 is positioned on either end of a transiting member 40. The stabilizing members 38 are aligned so that their holes 48 are aligned with the ends of the transiting member 40 protruding from the pier 32. The stabilizing members are also aligned so as to be perpendicular to the brackets 36.

Referring now to FIG. 4, the stabilizing members 38 engage the transiting member 40 thereby coupling the stabilizing members 38 on opposite faces to one another. In a preferred method of engagement, the protruding ends of the transiting members 40 are inserted through the holes 48 in the stabilizing members 38. The stabilizing members 38 are then secured against the face of the pier 32 as described below. After the stabilizing members 38 are in position, the tabs 46 at the ends of the stabilizing members may be folded to prevent horizontal movement of the stabilizing member with respect to the bracket 36. Alternatively, if the stabilizing members 38 utilized in the practice of the invention do not have tabs, the ends of the stabilizing members 38 may be bent around the corner of the pier to prevent horizontal movement of the stabilizing member 38. This arrangement is illustrated in FIG. 2 where the stabilizing members 38 are positioned across opposing faces of the pier 32.

The stabilizing members 38 may be secured by any known means such as sliding clips or welding. A preferred method, however, is to use washers 50 and nuts 52 as shown in FIGS. 4 and 5 to establish a joining force (or tension) between and among the stabilizing members 38 and the threaded rod transiting member 40. Tightening the nuts 52 and washers 50 tightens the stabilizing members against the brackets 36 and the opposing faces of the pier thereby exerting a stabilizing force on the brackets 36 and thus on the corners of the pier.

Although the above detailed description speaks in terms of masonry blocks and a metal stabilizing apparatus, those skilled in the art will readily recognize that the invention is easily adaptable for other building materials such as wooden blocks, composite blocks made of polymers, and bricks. Likewise the invention may be practiced with components made from other materials such as high strength polymers, provided they meet the size and strength requirements for the particular pier being reinforced.

Similarly, the invention is not limited to construction of new piers. The invention is also adaptable for use with existing piers. When utilized in this manner, prior inspection and repair of existing blocks in the pier is paramount. If the pier is deemed sound, a hole is drilled through the pier thereby forming a pathway for a transiting member. The transiting member is placed within the pathway and the remainder of the apparatus is constructed as previously described.

In a further embodiment the invention comprises a building, most typically a modular building reinforced against torsional loadings. The term modular as used herein encompasses both mobile, modular and prefabricated buildings and is used to describe any building not secured to a permanent foundation or capable of being moved. In this embodiment, the invention comprises a modular building with a foundation comprising piers reinforced against torsional loadings. Referring again to FIG. 1, a modular building 70 is supported by a network of piers 10. The piers 10 are formed of tiers of stacked blocks 34 as generally shown in FIGS. 2 and 5. The stacked blocks forming the pier possess at least two opposing faces, 42 and 44. The piers 10 are reinforced and stabilized against torsional loadings by reinforcing apparatus. The reinforcing apparatus comprises at least four brackets 36 positioned along the edges of two opposing faces 42 and 44 of the pier 10. The brackets 36 are of sufficient length to extend across the junction of at least two tiers.

At least one transiting member 40 is positioned intermediate the brackets 36 and transits the pier 10 perpendicularly intersecting the bracketed opposing faces, 42 and 44, of the pier 10. Each of the two opposing faces 42 and 44 is transversed by a stabilizing member 38 of sufficient length to transverse the brackets 36 along the outer edges of each face. The stabilizing members 38 engage with transiting members 40. The stabilizing members 38 are also secured to transiting members 40 so as to fit tightly against the brackets 36 bracketing the opposing faces 42 and 44.

Figure 6:
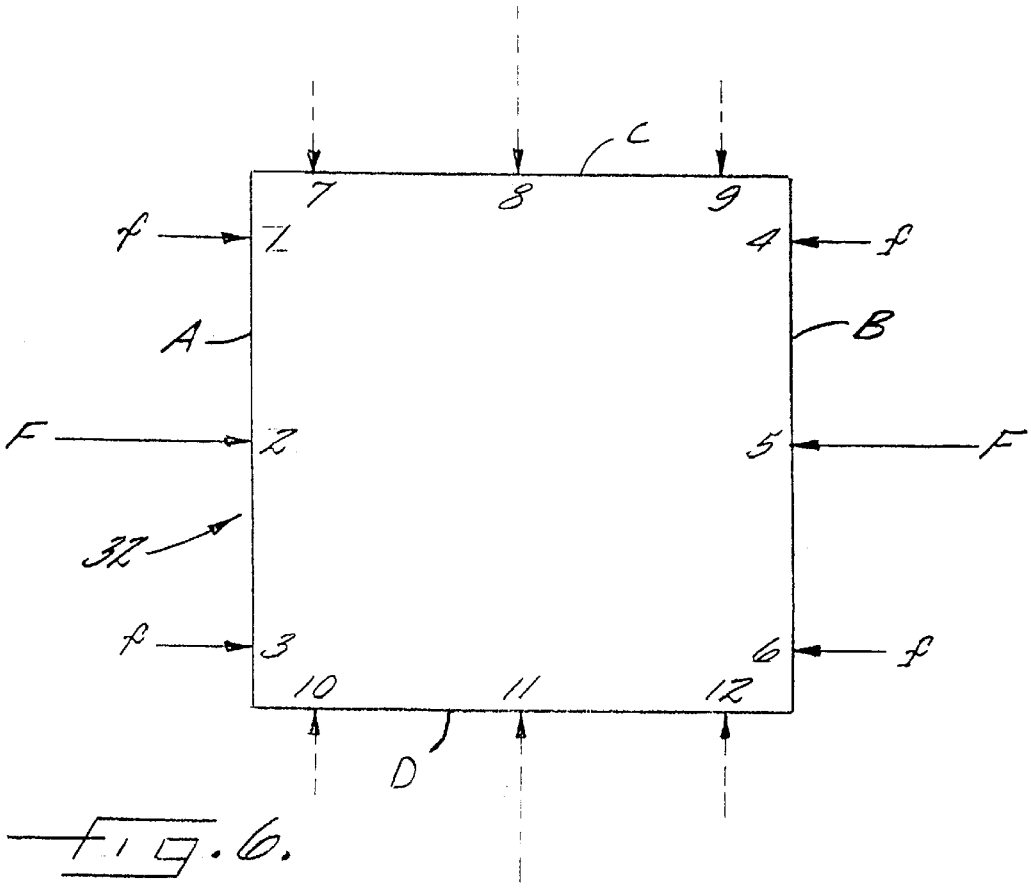
FIG. 6 is a schematic representation of the forces employed in one embodiment of the invention.

The invention may also be described in terms independent of the structure and physical components of the invention. Referring now to FIG. 6, there is shown a view taken from directly above a pier 32. In this embodiment the invention comprises a method of torsionally reinforcing a structure formed of at least two tiers of stacked polygonal blocks having at least first and second opposing faces. The first and second opposing faces are represented in FIG. 6 as A and B, respectively.

The method comprises establishing first, second and third force focal points on the first face A wherein the focal points are linearly arranged with the first and third focal points proximate the edges of the first face A and the second focal point intermediate the first and third points. Points 1, 2 and 3 in FIG. 6 illustrate this orientation of focal points.

Fourth, fifth and sixth force focal points are established on the second face B and are linearly arranged with the fourth and sixth focal points proximate the edges of the second face B. The fifth focal point is located intermediate the fourth and sixth focal points. Further, the fourth, fifth and sixth focal points are opposed, respectively, to the first, second and third focal points. Points 4, 5 and 6 in FIG. 6 illustrate this orientation of focal points.

A compressive force is established along a line joining the second and fifth focal points thereby creating compressive force F acting on the first and second faces A and B. The compressive force F acting on each face at the second and fifth focal points is distributed transversely along the first and second faces to create compressive forces f at the first, third, fourth and sixth focal points as shown in FIG. 6.

Similar forces may be created and distributed along other opposing faces of the pier (C and D) in the manner described above. Such forces are represented with dotted lines in FIG. 6. Depending upon the height of the pier, it may be necessary to create and distribute these forces of intervals along the height of the pier.

The invention has been described in detail, with reference to certain preferred embodiments, in order to enable the reader to practice the invention without undue experimentation. However, a person having ordinary skill in the art will readily recognize that many of the components and parameters may be varied or modified to a certain extent without departing from the scope and spirit of the invention. Furthermore, titles, headings, or the lie are provided to enhance the reader's comprehension of this document, and should not be read as limiting the scope of the present invention. Accordingly, only the following claims and reasonable extensions and equivalents define the intellectual property rights to the invention thereof.

That which is claimed is:

1. A method of reinforcing a structure formed of at least two tiers of stacked blocks against torsional loadings, the method comprising:

bracketing the edges of at least two opposing faces of the stacked blocks with brackets of sufficient length to extend across the junction of at least two tiers;

transiting the stacked blocks with a transiting member that intersects the two opposing faces intermediate of the brackets;

placing stabilizing members across the bracketed opposing faces such that the stabilizing members are transverse to the brackets; and establishing tension between the stabilizing members along the transiting member intersecting the two bracketed opposing faces.

2. A method according to claim 1 wherein the stacked blocks are selected from the group consisting of masonry blocks, concrete blocks, wood blocks, composite blocks and bricks.

3. A method according to claim 1 wherein the bracketing step comprises placing angle brackets along the edges of the stacked blocks.

4. A method according to claim 1 wherein the step of transiting the stacked blocks comprises placing a rod between successive tiers of blocks.

5. A method according to claim 1 wherein the step of transiting the stacked blocks comprises drilling a hole through the structure and placing a rod therethrough.

6. A method according to claim 1 wherein the stabilizing member further comprises a hole intermediate the ends of the stabilizing member.

7. A method according to claim 6 wherein the step of placing the stabilizing members further comprises preventing transverse movement of the stabilizing members in relation to the brackets.

8. A method according to claim 1 wherein the step of establishing tension between the stabilizing members comprises coupling the stabilizing members to one another.

9. A method according to claim 8 wherein the step of coupling comprises securing the stabilizing members to the transiting member.

10. An apparatus for stabilizing a structure formed of at least two tiers of stacked blocks against torsional loadings, the apparatus comprising:

at least four brackets positioned vertically along the corners of at least two opposing faces of the stacked blocks, said brackets being of sufficient height to extend at least above the first tier;

at least two horizontal stabilizing members, each said stabilizing member being situated across at least one of the bracketed opposing faces of the stacked blocks and with said stabilizing members traversing two adjacent said brackets; and a transiting member extending horizontally through the pier and joining two of said stabilizing members on opposite faces of the pier, so that the joining force between said transiting member and said stabilizing member also exerts a stabilizing force on said brackets and thus on the corner and pier.

11. An apparatus according to claim 10 wherein said brackets are angled steel.

12. An apparatus according to claim 10 wherein said stabilizing member further comprises a hole.

13. An apparatus according to claim 12 wherein said transiting member is a rod.

14. An apparatus according to claim 13 wherein said transiting member is a threaded rod which transits the structure and engages with said holes of said stabilizing members thereby coupling said stabilizing members.

15. An apparatus according to claim 14 wherein said stabilizing member further comprises means for preventing said stabilizing member from moving in a transverse manner in relation to said brackets.

16. An apparatus according to claim 14 wherein said transiting member further comprises nuts and washers for securing said rod and stabilizing members.

17. An apparatus for stabilizing a structure formed of at least two tiers of masonry blocks, the apparatus comprising:

at least four angled steel brackets positioned along the corners of at least two opposing faces of the stacked blocks, said brackets being of sufficient length to extend across the junction of at least two tiers of blocks;

at least two stabilizing members traversing said brackets, each of said members having a hole; and a threaded rod positioned intermediate said angled steel brackets, said threaded rod transiting the stacked blocks and engaging with said stabilizing members, through said holes, said threaded rod and said stabilizing members being secured by nuts and washers.

18. An apparatus according to claim 17 wherein said brackets, stabilizing members, threaded rods, nuts and washers are manufactured from the group consisting of metals and polymers.

19. A method of building a block pier for enhanced resistance to torsional loadings, the method comprising:

laying a first tier of blocks having opposing faces and top and bottom surfaces on the top surface of a footing, and with the bottom surface of the first tier being adjacent to the top surface of the footing, laying at least one additional tier of blocks of substantially the same cross-sectional area as the first tier upon the top surface of the first tier, the additional tiers having top and bottom surfaces with the top surface of one tier being adjacent to the bottom surface of the succeeding pier to form a multi-tiered pier having opposing faces, transiting the pier with a transiting member such that the transiting member intersects and extends perpendicularly from two opposing faces of the pier;

bracketing the corners of the two opposing faces of the pier intersected by the transiting members with brackets of sufficient length to extend across the junction of at least two tiers of the multi-tiered pier;

placing stabilizing members across the bracketed faces; and securing the stabilizing members to the tensioning member.

20. A method according to claim 19 wherein the blocks are selected from the group consisting of masonry blocks, concrete blocks, wood blocks, composite blocks and bricks.

21. A method according to claim 19 wherein the step of transiting the pier comprises placing a rod between successive tiers of blocks.

22. A method according to claim 19 wherein the step of transiting the pier comprises drilling a hole through the pier and placing a rod therethrough.

23. A method according to claim 19 wherein the stabilizing member further comprises a hole intermediate the ends of the stabilizing member.

24. A method according to claim 19 wherein the step of placing the stabilizing members further comprises preventing transverse movement of the stabilizing members in relation to the brackets.

25. A building having a foundation comprising piers reinforced against torsional loading, said building comprising at least one pier formed of blocks stacked in at least two tiers, the stacked blocks having at least two opposing faces and being reinforced and stabilized by a stabilizing apparatus, the stabilizing apparatus comprising at least four brackets positioned along the edges of two opposing faces of the pier, said brackets being of sufficient length to extend across the junction of at least two tiers; a transiting member positioned intermediate the brackets that transits the pier perpendicularly intersecting the bracketed opposing faces of the pier, and at least two stabilizing members with each member situated across one of the two opposing faces such that the stabilizing members transverse the brackets and engage the transiting member.

26. A method of torsionally reinforcing a structure formed of at least two tiers of stacked polygonal blocks with the tiers having at least first and second opposing faces, the method comprising:

establishing linearly arranged first, second and third force focal points on the first face, with the first and third focal points being proximate the edges of the first face and with the second focal point being intermediate the first and third points;

establishing linearly arranged fourth, fifth and sixth force focal points on the second face, with the fourth and sixth focal points being proximate the edges of the second face, and the fifth focal point being intermediate the fourth and sixth focal points, and where the fourth, fifth and sixth focal points are opposed, respectively, to the first, second and third focal points;

applying a compressive force to the first and second faces along the line established between the second and fifth focal points; and distributing the compressive force formed at the second and fifth focal points transversely along the first and second faces to create additional compressive forces between the first and second faces at the first, third, fourth and sixth focal points.

27. A method according to claim 26 wherein the steps of establishing force focal points, applying a compressive force and distributing the compressive force are repeated at intervals along the height of the structure.

28. A method of torsionally reinforcing a structure formed of at least two tiers of stacked six sided blocks with the tiers having at least first and second vertical opposing faces and third and fourth vertical opposing faces, the method comprising:

establishing linearly arranged first, second and third force focal points on the first face, with the first and third focal points being proximate the edges of the first face and with the second focal point being intermediate the first and third points;

establishing linearly arranged fourth, fifth and sixth force focal points on the second face, with the fourth and sixth focal points being proximate the edges of the second face and the fifth focal point being intermediate the fourth and sixth focal points, and where the fourth, fifth and sixth focal points are opposed, respectively, to the first, second and third focal points;

applying a first compressive force to the first and second faces along the line established between the second and fifth focal points;

distributing the compressive force formed at the second and fifth focal points transversely along the first and second faces to create additional compressive forces between the first and second faces at the first, third, fourth and sixth focal points;

establishing linearly arranged seventh, eighth and ninth force focal points on the third face, with the seventh and ninth focal points being proximate the edges of the third face and with the eighth focal point being intermediate the seventh and ninth points;

establishing linearly arranged tenth, eleventh and twelfth force focal points on the fourth face, with the tenth and twelfth focal points being proximate the edges of the fourth face and the eleventh focal point being intermediate the tenth and twelfth focal points, and where the tenth, eleventh and twelfth focal points are opposed, respectively, to the seventh, eighth and ninth focal points;

applying a second compressive force to the third and fourth faces along the line established between the eighth and eleventh focal points; and distributing the compressive force formed at the eighth and eleventh focal points transversely along the first and second faces to create additional compressive forces between the third and fourth faces at the seventh, ninth, tenth and twelfth focal points.

29. A method according to claim 28 wherein the first through sixth force focal points are located in a first horizontal plane and the seventh through twelfth force focal points are located in a second horizontal plane, with the first and second horizontal planes separated by a distance.

30. A method according to claim 29 wherein the steps of establishing first through sixth force focal points and seventh through twelfth focal points, applying first and second compressive forces, and distributing the compressive forces are repeated at least once at intervals along the height of the structure.

* * * * *